US005270113A

United States Patent [19]

Rebouillat

[11] Patent Number: 5,270,113

[45] **Date of Patent: * Dec. 14, 1993**

[54] HIGHLY PROCESSABLE AROMATIC POLYAMIDE FIBERS, THEIR PRODUCTION AND USE

[75] Inventor: Serge Rebouillat, Midlothian, Va.

[73] Assignee: E. I. Du Pont de Nemours and Company, Wilmington, Del.

[ * ] Notice: The portion of the term of this patent subsequent to Mar. 2, 2010 has been disclaimed.

[21] Appl. No.: 844,271

[22] Filed: Mar. 2, 1992

Related U.S. Application Data

[63] Continuation-in-part of Ser. No. 575,543, Aug. 30, 1990, Pat. No. 5,139,873.

[30] Foreign Application Priority Data

Sep. 5, 1989 [DE] Fed. Rep. of Germany ..... 3929376
Mar. 2, 1991 [DE] Fed. Rep. of Germany ..... 4106682

[51] Int. Cl.[5] ..... D06M 13/10; B05D 3/02

[52] U.S. Cl. ..... 428/375; 252/8.6; 427/314; 427/384; 427/385.5; 427/394; 428/378; 428/395; 428/911

[58] Field of Search ..... 428/379, 378, 395, 911; 252/8.6; 427/314, 384, 394, 385.5

[56] References Cited

U.S. PATENT DOCUMENTS

| | | | |
|---|---|---|---|
| 3,113,369 | 12/1963 | Barrett et al. | 428/395 |
| 3,287,324 | 11/1966 | Sweeny | 528/348 |
| 3,859,122 | 1/1975 | Burks, Jr. et al. | 252/8.9 |
| 3,869,429 | 3/1975 | Blades | 528/341 |
| 3,997,450 | 12/1976 | Steinmiller | 252/8.7 |
| 4,038,258 | 7/1977 | Singh et al. | 428/395 |
| 4,179,544 | 12/1979 | Newkirk et al. | 428/395 |
| 4,291,093 | 9/1981 | Wishman et al. | 428/379 |
| 4,455,341 | 6/1984 | Harteman | 428/225 |
| 4,606,972 | 8/1986 | Marshall | 428/395 |
| 4,613,535 | 9/1986 | Harpell et al. | 428/113 |
| 4,670,343 | 6/1987 | Makino | 428/395 |
| 4,929,504 | 5/1990 | Veitenhansl et al. | 428/395 |
| 4,957,648 | 9/1990 | Yodice et al. | 252/8.6 |
| 5,139,873 | 8/1992 | Rebouillat | 428/375 |

FOREIGN PATENT DOCUMENTS

| | | |
|---|---|---|
| 107887 | 5/1984 | European Pat. Off. . |
| 136727 | 8/1987 | European Pat. Off. . |
| 239915 | 10/1987 | European Pat. Off. . |

OTHER PUBLICATIONS

Research Disclosure, May 1978, No. 169, disc. 16949.
Research Disclosure, Jul. 1980 disc. 19520.

*Primary Examiner*—George F. Lesmes
*Assistant Examiner*—Christopher Brown

[57] ABSTRACT

The invention relates to aramid fibers having a coating of a lubricant, an emulsifying system, and an antistatic agent; and to a process for making them.

16 Claims, No Drawings

HIGHLY PROCESSABLE AROMATIC POLYAMIDE FIBERS, THEIR PRODUCTION AND USE

This is a continuation-in-part of application Ser. No. 07/575,543, filed Aug. 30, 1990, now U.S. Pat. No. 5,139,873.

BACKGROUND OF THE INVENTION

1. Field of the Invention

The present invention relates to highly processable aromatic polyamide fibers, their production and use.

2. Description of the Prior Art

Research Disclosure, July 1980, No. 195, disclosure 19520, discloses finishes useful for treating industrial fibers, such as polyamide and aramid fibers, which finishes include a lubricant, comprising esters composed of an aliphatic, saturated carboxylic acid and a polyhydric or aliphatic unbranched alcohol. These finishes also contain an emulsifier or emulsifying system, an anti-oxidant to increase the stability of the composition, polysiloxanes as a further thermostable lubricant, and a sulfonated natural oil as an antistatic agent. Furthermore, these finishes may contain biostats, further emulsifiers, and lubricants.

However, the finishes according to the above reference are not suitable for the purposes of the present invention in terms of surface frictional properties, scourability, the protection from depositing due to abrasion, fibrillation and antistatic properties of the resulting treated fibers.

High strength, high modulus fibers, have been proposed to reinforce elastomeric and plastic materials.

SUMMARY OF THE INVENTION

Most commercial fibers have a high rigidity, poor surface functional characteristics leading to fibrillation, mainly caused by excessive friction among filaments, and poor surface affinity to most traditional elastomeric, thermoplastic and thermoset matrices which they reinforce.

These drawbacks and defects, which result in a degradation of physical properties such as strength and modulus, have been driving a high demand for highly processable fibers which have to be easy to process through knitting or weaving operations and do not lead to machine deposits.

According to this invention, the application of a particular combination of surface treatment agents on the surface of previously dried aramid fibers using a finishing process already known; or the application of those agents on never-drawn never-dried aramid fibers yields a new surface treated fiber which exhibits excellent processability characteristics in its use as a reinforcing element for rubber applications or as a yarn for fabric woven structures. The end use performance of final products, using the fibers, is consequently significantly improved.

The present invention accordingly relates to highly processable aramid fibers of high modulus, improved surface frictional properties, improved scourability, low abrasion polymer depositing, low fibrillation and improved longterm antistatic properties, having a coating of a lubricant, an emulsifying system, an antistatic agent, and other components, derived from a surface treatment agent which consists of (a) 30 to 70% by weight of an esteroil lubricant, consisting of an ester, composed of (I) an alcohol component which is a branched, primary or secondary, saturated monohydric alcohol of the general formula $$CH_3-(CH_2)_h-\overset{R^1}{\overset{|}{(CH)_k}}-(CH_2)_j-\overset{R^2}{\overset{|}{CH}}-(CH_2)_m-OH$$

wherein $R^1$ represents $C_1$–$C_{16}$-alkyl, $R^2$ represents H, $C_1$–$C_{16}$-alkyl,, if k=1 and $R^2$ represents $C_1$–$C_{16}$-alkyl, if k=0, h=0 to 5 k=0 or 1 j=0 to 4 m=0 to 16 and wherein the total number of carbon atoms is below 25, and (II) a carboxylic acid component which is an unsaturated fatty acid of the general formula $R^3$—(-COOH)$_s$; s=1–6 wherein $R^3$ represents $C_4$–$C_{19}$-alkenyl, $C_4$–$C_{19}$-alkadienyl, $C_4$–$C_{19}$-alkatrienyl, phenyl, naphthyl, 2-phenylethenyl, or which is an unsaturated dicarboxylic acid of the general formula $$HOOC-(CH{=}CH)_n-COOH$$

wherein n=1 or 2, and said ester has a solidification point of below +5° C., preferably below 0° C., a kinematic viscosity of 100 to 350 mm$^2$/s (at 20° C.) and an iodine value between 30 and 140, preferably between 30 and 80, (b) 20 to 50% by weight of an emulsifying system which consists of unsaturated ethoxylated fatty acids and/or unsaturated ethoxylated fatty alcohols and/or ethoxylated alkylamines of the general formula $$R^4-X-(EO)_p(PO)_q-OH$$

wherein $R^4$ represents $C_5$–$C_{20}$-alkenyl, phenyl, naphthyl, or $C_8$- or $C_9$-alkylphenyl, X represents —COO—, —NH— or —O—, EO represents an ethylene oxide unit, PO represents a propylene oxide unit, p=2 to 15 and q=0 to 10, (c) 5 to 15% by weight of an antistatic agent, consisting of alkali salts of $C_4$–$C_{12}$-alkyl sulfonates, $C_4$–$C_{12}$-alkyl phosphates or $C_4$–$C_{20}$-alkyl carboxylic acids, (d) 0.2 to 2% by weight of a corrosion-inhibitor, and (e) optionally additives, and whereby the amount of said coating on said fibers is 0.05 to 2.0% by weight, preferably 0.2 to 1.0% by weight, of the fiber.

The coating preferably consists of 50 to 60% by weight, most preferably 55 to 60% by weight of the esteroil (a), 25 to 40% by weight, most preferably 29 to 35% by weight of the emulsifying system (b), 5 to 10% by weight, most preferably 5 to 7% by weight of the antistatic agent (c), 0.3 to 1% by weight, most preferably 0.3 to 0.5% by weight of the corrosion inhibitor (d) and, if desired, optionally additives (e).

The aramid fibers of this invention are further characterized by a specific breaking strength of 2.65 to 33.5 cN/dtex (3 to 38 g/den), a specific modulus of 8.83 to 2207 cN/dtex (10 to 2500 g/den), a fiber to metal dynamic friction coefficient on a 1100 dtex aramid yarn of lower than 0.55, preferably below 0.50 at 200 m/min, a fiber to metal boundary friction coefficient on a 1100 dtex aramid yarn of lower than 0.10, preferably below 0.05 at 0.016 cm/s, an amount of deposit due to abrasion of lower than 0.5 mg/kg of yarn, a residual finish level of lower than 15% by weight of the initial finish level after washing.

The fiber of this invention provides an improved blend of properties in terms of fume emission measured by weight losses, washability of the fiber and cohesiveness of the fiber compared with fibers using other finishes.

Within the scope of this invention, by "fibers" are meant continuous filaments as well as a single yarn or cord, staple fibers, fiber tows (for example from stretch breaking processes), yarns or flat textile skeins, staple crimped fibers, pulps, industrial woven, twisted, knitted, braided, spiralled or wrapped textiles from aramids with a fiber type structure.

Aramids are such polymers that are partially, preponderantly or exclusively composed of aromatic rings, which are connected through carbamide bridges or optionally, in addition also through other bridging structures. The structure of such aromatic polyamides can be elucidated by the following general formula of repeating units:

$$(\text{—CO—NH—}A_1\text{—NH—CO—}A_2\text{—CO—})_n$$

wherein $A_1$ and $A_2$ are the same or different and signify aromatic and/or polyaromatic and/or heteroaromatic rings, that can also be substituted. Typically $A_1$ and $A_2$ may, independently from each other, be selected from 1,4-phenylene, 1,3-phenylene, 1,2-phenylene, 4,4'-biphenylene, 2,6-naphthylene, 1,5-naphthylene, 1,4-naphthylene, phenoxyphenyl-4,4'-diylene, phenoxyphenyl-3,4'-diylene, 2,5-pyridylene and 2,6-quinolylene which may or may not be substituted by one or more substituents which may comprise halogen, $C_1$–$C_4$-alkyl, phenyl, carboalkoxyl, $C_1$–$C_4$-alkoxyl, acyloxy, nitro, dialkylamino, thioalkyl, carboxyl and sulfonyl. The —CONH—group may also be replaced by a carbonylhydrazide (—CONHNH—) group, azo-or azoxygroup.

Fibers derived from wholly aromatic polyamides are preferred. Examples of aramids are poly-m-phenyleneisophthalamide and poly-p-phenylene-terephthalamide.

Especially suitable are poly-m-phenylene-isophthalamide fibers according to U.S. Pat. No. 3,287,324 and poly-p-phenylene-terephthalamide fibers according to U.S. Pat. No. 3,869,429 and DE 22 19 703.

Additives can be used with the aramid and, in fact, it has been found that up to as much as 10 percent by weight of other polymeric material can be blended with the aramid or that copolymers can be used having as much as 10 percent by weight of other diamine substituted for the diamine of the aramid or as much as 10 percent by weight of other diacid chloride substituted for the diacid chloride of the aramid.

Additional suitable aromatic polyamides are of the following structure $$(\text{—NH—}Ar_1\text{—X—}Ar_2\text{—NH—CO—}Ar_1\text{—X—}Ar_2\text{—CO—})_n$$

in which

X represents O, S, $SO_2$, NR, $N_2$, $CR_2$, CO,

R represents H, $C_1$–$C_4$-alkyl, and $Ar_1$ and $Ar_2$ which may be same or different are selected from 1,2-phenylene, 1,3-phenylene and 1,4-phenylene and in which at least one hydrogen atom may be substituted with halogen and/or $C_1$–$C_4$-alkyl.

The finish formulation of this invention comprises a lubricant, an emulsifying system, an antistatic agent and a corrosion inhibitor, and if desired, water and/or other additives.

The lubricant is an esteroil which is characterized as stated above. Examples for the alcohol compound (I) of the ester can be 2-methyl-1-propanol, 2-butanol, 2-pentanol, 2-methyl-1-butanol, 3-methyl-3-1-butanol, 3-methyl-2-butanol, 2-methyl-1-pentanol, 4-methyl-1-pentanol, 4-methyl-2-pentanol, 2-pentanol, 3-heptanol, 2-octanol, 2-ethyl-1-hexanol, 3,5-dimethyl-1-hexanol, 5-nonanol, 2–6-dimethyl-4-heptanol, iso-hexadecyl alcohol or iso-tridecyl alcohol. Examples for the carboxylic acid component (II) can be lauroleic acid, myristoleic acid, palmitoleic acid, oleic acid, gadoleic acid, erucic acid, ricinoleic acid, tallow acid, linoleic acid, linolenic acid, fumaric acid, maleic acid, cinnamic acid, naphthaline carboxylic acid, benzoic acid, terephthalic acid, isophthalic acid, trimellitic acid or pyromellitic acid.

The kinematic viscosity of the esteroil preferably is in the range of 200 to 300 $mm^2/s$ (20° C.).

The emulsifying system of this invention is as defined above. Examples of unsaturated fatty acids are lauroleic acid, myristoleic acid, palmitoleic acid, gadoleic acid, erucic acid or ricinoleic acid, preferably oleic acid ( with 3–15 moles ethylene oxide). Examples of unsaturated fatty alcohol are elaidyl alcohol, erucyl alcohol, brassidyl alcohol, preferably oleyl alcohol and/or tallow alcohol (with 3–10 moles of EO). Further examples are $C_8$- or $C_9$-alkylphenolethoxylates, preferably octylphenol- or nonylphenolethoxylates (5—5moles of EO).

The antistatic compounds are alkali salts, preferably sodium salts of alkyl sulfonates (e.g. lauryl or oleyl sulfonate), alkyl phosphates like $C_4$–$C_{12}$-alkyl phosphates (mono/diester mixture) and salts of fatty acids, e.g. oleic acid. The sodium chloride content should be below 0.1%. It is also possible to use alkylsulfates, however, they are not preferred because they hydrolyze easily and therefore loose their antistatic efficiency.

Useful corrosion inhibitors are diethanolamine salts of $C_4$–$C_{12}$-alkylphosphate-esters (mono/di) or amine salts of fatty acids or benzoic acid.

The formulation may optionally contain water for stabilization reasons even before it is diluted with water in order to obtain the concentration at which it is applied to the fibers.

Additives can optionally be incorporated in the formulation if specific properties or process conditions are required, for example adhesion, specific crosslinkage, UV-protection, antioxidation, pigmentation or rheological adjustment. These additives may further comprise fungicides, bacteriocides and biocides.

A formulation for the treatment of aramid fibers can be prepared by mixing all components at an elevated temperature, preferably at a temperature between 30° C. and 40° C., in order to obtain a homogeneous and clear oil. Thus, for example, a mixture consisting of 550 g of isobutyl oleate, 350 g of emulsifying system which consists of 200 g nonylphenol ethoxylate (8 EO) and 150 g of oleic acid ethoxylate (10 EO), 70 g of sodium decylsulfonate and 5 g of the diethanolamine salt of benzoic acid can be prepared. If necessary, about 25 g of water is added to the mixture to eliminate any turbidity. The addition of water may also be necessary to obtain a stable clear oil. If required, the pH value can be adjusted to be within 6 and 8, preferably 7, using diethanolamine or acetic acid.

The finish formulation of this invention is further characterized by a viscosity of 150 to 500 $mm^2/s$, preferably of 150 to 300 $mm^2/s$ (at 20° C.), a weightloss of less than 25%, preferably less than 15%, after 2 h at 200° C., a surface tension of a 1% emulsion of less than 35 mN/m, preferably less than 32 mN/m at 20° C.

The invention further relates to a process for the production of a highly processable aromatic polyamide fiber coated on the surface with a surface treatment agent.

Coating of aramid fibers with the surface treatment agent of this invention can take place in various ways and, more specifically, for example, according to the following processes (a) and (b).

According to process (a), the application of the surface treatment agent is made on never-dried never-drawn aramid fiber; and according to process (b) the application of the surface treatment agent is done on previously dried aramid fiber, in each case using any known coating device. The finish formulation is used neat or in a diluted aqueous form, which is in a concentration of as low as 1% by weight.

In the preferred route for process (a), the finish formulation is applied in a concentration of about 30% by weight in water (this means 30 parts by weight finish formulation+70 parts by weight water) on a wet aramid fiber. The emulsion treated fiber is then dried during the fiber stretching drying step at a temperature between 150° and 190° C., preferably at around 170° C. for few seconds (5–10 s) while the yarn speed is around 630 m/min (workable range 120–1200 m/min).

In the preferred route of process (b) yarns and cords of aramid fibers are passed through a dip of the finish formulation in a dipping unit to coat them and then are dried in an air heated chamber at 80° to 190° C., preferably at 110° to 130° C. with a predetermined tension of 6N for an untwisted 1670 dtex yarn. The most preferred temperature for this step is about 120° C. Depending on the dip concentration for the finish formulation, which may be from 1% to 100by weight in water, the speed is adjusted to be from 15 to 100 m/min. By a finish formulation of 100%, is meant that the finish is neat.

The finish levels for both processes, (a) and (b), are in the range of 0.05 to 2% by weight, preferably 0.2 to 1.0% by weight.

If desired, processes (a) and (b) can be conducted as a multi-step process in which the fiber may be several times immersed in a surface treatment agent and in turn dried. For example, the treatment agent can be applied on the never-dried wet fiber, then the fiber can be dried and thereafter the surface treatment agent can be applied once more or even several times more with or without intermediate drying.

Fibers of this invention can be used in the reinforcement of hoses, belts, ropes and cables including optical cables, rubber goods and composite structures (e.g. sporting goods, medical supplies, building and acoustic material, transport and protective equipment for civil and military applications).

DESCRIPTION OF PREFERRED EMBODIMENTS

Example 1

In this example, aramid fiber in a yarn of 1100 dtex and coated by the finish of this invention was compared with commercially-available aramid yarn of the same dtex coated by a standard finish.

The aramid fiber of this invention shows superiority, in terms of friction, especially dynamic friction F/M (200 m/min), deposit measured in mg/kg of yarn, and fibrillation compared to the control aramid fiber (Comparison) which is commercially available.

For antistatic evaluation, a generally good performance starts at −6 kV, consequently the measured value of −2.5 kV for the fiber of this invention is excellent in terms of staticity.

The scourability (wash-off property) is a very important factor since the residual finish level after a washing-step (measured in %) impacts any subsequent finishing operation. Scourability values mentioned in the Table below were obtained on an industrial scale using fabrics made of the yarn of this invention and compared with a control yarn which was a commercial product of the same denier treated with a standard finish. The values were confirmed in the laboratory by washing the yarns two times with soft water at 50° C. using 100 ml of water for 10 g of yarn.

Friction coefficients were determined according to the following method: A package of yarn is threaded through a tensioning device, between a guide roll and two strain gauges, and onto a take-up roll driven by a variable speed motor. The two strain gauges record $T_1$ and $T_2$ input and output tension respectively. The coefficient of friction is computed according to the formula:

$$T_1/T_2=\exp(\alpha.f)$$

where $\alpha$ is the friction angle and f the friction coefficient (fiber to fiber, fiber to metal or fiber to ceramic, depending on whether a polished chrome or ceramic pin was used). The Rothschild friction meter R-1182 has been used according to the standard procedure known in the art.

The deposit due to abrasion was measured on a "Staff-Tester G 555" (Zweigle, West Germany) with which the weight of the abraded fiber-material arising from fiber to fiber friction was determined.

The fibrillation index was determined on a "G 566" apparatus (Zweigle, West Germany).

Comparison of physical properties

| (1100 dtex Fiber) | Comparison | This Invention |
|---|---|---|
| 1. Friction | | |
| Fiber/Fiber | | |
| (0.016 cm/s) | 0.22 | 0.215 |
| (128 cm/s) | 0.28 | 0.265 |
| Fiber/Metal | | |
| (0.016 cm/s) | 0.12 | 0.045 |
| (128 cm/s) | 0.30 | 0.265 |
| (200 m/min) | 0.70 | 0.55 |
| 2. Deposit (mg/kg) | 10 | 0.5 |
| 3. Fibrillation index | 21 | 2–5 |
| 4. Scourability (Residual finish level) | 46% | 9% |

Example 2

In this example, a fabric woven from the yarn of this invention and a comparison fabric woven from commercially available yarn having a standard finish were tested for ballistic performance.

The fabrics were made of 1111 dtex (1000 denier) yarns.

Usually in the area of high tenacity fiber the weaving operation of ballistic fabrics leads to strength losses usually quantified by extracting the yarn out of the fabric and measuring the tenacity according to the standard procedures known in the art. The following Table shows that the product of this invention yields a significant advantage since, in a heavy fabric construction (typically 12 ends per cm), the strength loss is reduced by half (7 vs. 14%). The ballistic performance ($V_{50}$: see test procedure) is also improved by 8% at the greige fabric level and 5 to 8% at the finished level (meaning after final fabric treatment).

In the case of light weight fabric, typically 8 ends per cm, the ballistic performance is also increased by 4.5% at the greige fabric level.

Strength Conversion and Ballistic Performance

| Fabric Grade | Strength Loss, This Invention | Strength Loss, Comparison | Percentage improvement in Ballistic Performance $V_{50}$ of This Invention vs. Comparison |
|---|---|---|---|
| HEAVY FABRIC of the state of the art: | | | |
| 1. greige | 5%-9% | 14%-18% | |
| 2. ballistic perform. (greige fabric) | | | +8% |
| 3. ballistic perform. (finished fabric) | | | +5-8% |
| LIGHT FABRIC of the state of the art | | | |
| 1. greige | 0-2% | 0-2% | |
| 2. ballistic perform. (greige fabric) | | | +5% |

Ballistic tests

The ballistic test method for determining $V_{50}$ was carried out according to the NATO standardization agreement STANAG 2920.

The $V_{50}$ ballistic limit velocity for a material or armour is defined as that velocity for which the probability of penetration of the chosen projectiles is exactly 0.5, using the Up and Down firing method and calculation described below.

The Up and Down firing method:

The first round shall be loaded with the amount of propellant calculated to give the projectile a velocity equivalent to the estimated $V_{50}$ ballistic limit of the armour. If the first round fired produces a complete penetration, the second round shall be loaded with a fixed decrement of propellant calculated to produce a velocity about 30 m/s lower than the first. If the first round fired results in a partial penetration, the second round shall be loaded with a fixed increment of propellant calculated to produce a velocity about 30 m/s higher than the first round. Upon achieving the first set of penetration reversals, the propellant charge should be adjusted with the fixed amount to yield an increment or decrement of velocity of about 15 m/s. Firing will then continue in accordance with a given procedure to obtain an estimate of the $V_{50}$ (BLP) [Ballistic Limit Protection].

$V_{50}$ calculation:

After a number of projectiles have been fired the $V_{50}$ is calculates as the mean of the velocities recorded for the fair impact the fair impacts consisting of the three highest partial velocities for partial penetration and the three lowest velocities for complete penetration provided that all six velocities fall within a bracket of 40 m/s.

Example 3

In this example, knitting processability evaluation was carried out under the following conditions: ELHA Circular Knitting Machine (Model RRU), test duration 4 hours, machine speed 670 rpm, knitting speed 15 m/min; knitting construction 3 stitches/cm.

End-Use Performance of Different Yarn Types

| Yarn Type | Comparison 0 T/m | Comparison 120 T/m | This Invention Process (a) and (b) 0 T/m |
|---|---|---|---|
| Fibrillation | high | none | none |
| Knit Design | not uniform | uniform | uniform |
| Deposit | build-up, deposit | slight deposit | no deposit |
| Coverage Factor | not uniform | low | optimum |

As can be seen in the table, above, optimum productivity levels and maximum value in use could be obtained using yarns of this invention versus the Comparison yarns. The state of the art product is used twisted. The results clearly show the advantage related to the possibility of avoiding the twisting operation by using yarns of this invention.

Example 4

In this example, fatigue trials on hoses, made using yarn of this invention, were carried out to the Ford specification with pressures of 1-3.5 bar at 0.5 Hz according to the most severe trapezoid waveform.

With Comparison yarn, 50,000 cycles to failure are generally obtained and are sufficient to pass the test. However, a result of 80,000 cycles has been obtained for five hose samples containing yarns of this invention. This shows a significant superiority of the yarns of this invention in terms of fatigue resistance.

Example 5

In this example, the strength efficiency conversion of cords made using yarns of this invention was compared with that of cords made using Comparison yarns.

Compared with commercially available aramid based construction, up to 30% better strength efficiency conversion was obtained by using yarn of this invention for cord construction. If a cord is made of several yarns, the strength of the cord theoretically should be equal to the strength of each yarn, multplied by the number of yarns, which is never the case in practice. However, the finish of this invention helps to overcome this problem.

In a laboratory test, the strength of a parallel construction made of three commercial 1100 dtex (1000 filaments) aramid yarns with a final twisting of 140 T/m (twists per meter) was determined to be 524N. This was compared with a parallel cord construction made of three 1100 dtex yarns which were treated with the finish of this invention (0.8% by weight finish level). The finally obtained strength of a yarn with a twist level of 140 T/m was 592N which corresponds to a 30% increase.

Example 6

In this example, several qualities of yarn of this invention were tested and compared with those qualities as exhibited by Comparison yarn.

Test conditions:

Weight loss is measured by the percentage of finish material lost after exposing the fibers at 230° C. for 8 hours. The finish percentage is determined by solvent extraction before and after the heat exposure.

The percentage of residue after scouring is also determined by solvent extraction of the residual finish remaining on the fiber after washing (scouring) the fiber according to washing procedures known and applied in the industry. The percentage is calculated versus the initial finish level determined prior to the scouring step.

The fiber to metal (F/M) friction coefficient is measured at 150 m/min using the Rothchild equipment and method as described previously.

| Fiber | Finish weight loss on heating | Finish remaining after scouring | F/M friction coefficient |
|---|---|---|---|
| A This invention ("non-fuming") | 5 | 8 | 0.50 |
| B This invention | 11 | 14 | 0.47 |
| C Comparison | 23 | 45 | 0.65 |

All yarns were 1000 denier, 670 filament and were coated in the dried state using a neat finish formulation at a rate of 750 m/minute to a level of 0.8%.

The finish of A included a 70/30 mixture of benzene tricarboxylic acid and benzene dicarboxylic acid as the carboxylic acid component for the esteroil. The finish of B included a 70/30 mixture of C-18/C-16 alkenyl monocarboxylic acid component for the esteroil.

The finish of the Comparison was C-12/C-15 mineral oil-based as disclosed in Research Disclosure No. 195, disclosure 19520, July, 1980.

By this example, it is noted that finish formulations of this invention in which a carboxylic acid component for the esteroil is used having more than one carboxylic acid group, that is, where n=2–6, the finish formulation yields considerably less weight loss on heating. Less weight loss on heating means less fuming in use and operation at elevated temperatures.

I claim:

1. Aramid fibers having a coating of a lubricant, an emulsifying system, an antistatic agent, and other components, derived from a surface treatment agent which consists of (a) 30 to 70% by weight of an esteroil lubricant, consisting of an ester, composed of (I) an alcohol component which is a branched, primary or secondary, saturated monohydric alcohol of the general formula $$CH_3-(CH_2)_h-\overset{R^1}{\overset{|}{(CH)_k}}-(CH_2)_j-\overset{R^2}{\overset{|}{CH}}-(CH_2)_m-OH$$

wherein $R^1$ represents $C_1$–$C_{16}$-alkyl, $R^2$ represents H, $C_1$–$C_{16}$-alkyl, if K=1 and $R^2$ represents $C_1$–$C_{16}$-alkyl, if k=0, h=0 to 5 j=0 to 4 k=0 or 1 m=0 to 16 and wherein the total number of carbon atoms is below 25, and (II) a carboxylic acid component which is an unsaturated fatty acid of the general formula $$R^3-(COOH)_s;\ s=1-6$$

wherein $R^3$ represents $C_4$–$C_{19}$-alkenyl, $C_4$–$C_{19}$-alkadienyl, $C_4$–$C_{19}$-alkatrienyl, phenyl, naphthyl, 2-phenylethenyl, or which is an unsaturated dicarboxylic acid of the general formula $$HOOC-(CH{=}CH)_n-COOH$$

wherein n=1 or 2, and said ester has a solidification point of below +5° C., a kinematic viscosity of 100 to 350 $mm^2/s$ (at 20° C.) and an iodine value between 30 and 140, (b) 20 to 50% by weight of an emulsifying system which consists of unsaturated ethoxylated fatty acids and/or unsaturated ethoxylated fatty alcohols and/or ethoxylated alkylamines of the general formula $$R^4-X-(EO)_p(PO)_q-OH$$

wherein $R^4$ represents $C_5$–$C_{20}$-alkenyl, phenyl, naphthyl, or $C_8$- or $C_9$-alkylphenyl, X represents —COO—, —NH— or —O—, EO represents an ethylene oxide unit, PO represents a propylene oxide unit, p=2 to 15 and q=0 to 10, (c) 5 to 15% by weight of an antistatic agent, consisting of alkali salts of $C_4$–$C_{12}$-alkyl sulfonates, $C_4$–$C_{12}$-alkyl phosphates or $C_4$–$C_{20}$-alkyl carboxylic acids, (d) 0.2 to 2% by weight of a corrosion-inhibitor, and (e) optionally additives, and whereby the amount of said coating on said fibers is 0.05 to 2.0% by weight.

2. Fibers according to claim 1, characterized in that said alcohol component (I) of (a) is 2-methyl-1-propanol, 2-butanol, 2-pentanol, 2-methyl-1-butanol, 3-methyl-1-butanol, 3-methyl-2-butanol, 2-methyl-1-pentanol, 4-methyl-1-pentanol, 4-methyl-2-pentanol, 2-pentanol, 3-heptanol, 2-octanol, 2-ethyl-1-hexanol, 3,5-dimethyl-1-hexanol, 5-nonanol, 2-6-dimethyl-4-heptanol, iso-hexadecyl-alcohol or iso-tridecyl alcohol.

3. Fibers according to claim 1, characterized in that said carboxylic acid component (II) of (a) is lauroleic acid, myristoleic acid, palmitoleic acid, oleic acid, gadoleic acid, erucic acid, ricinoleic acid, tallow acid, linoleic acid, linolenic acid, fumaric acid, maleic acid, cinnamic acid, naphthaline carboxylic acid, benzoic acid, terephthalic acid, isophthalic acid, trimellitic acid or pyromellitic acid.

4. Fibers according to claim 1, characterized in that said emulsifying system comprises octylphenol-ethoxylates (5-15 moles of EO) and/or nonylphenolethoxylates (5-15 moles of EO) and/or ethoxylated lauroleic acid, myristoleic acid, palmitoleic acid, gadoleic acid, erucic acid, ricinoleic acid, or oleic acid (3-15 moles of EO) and/or ethoxylates of elaidyl alcohol, erucyl alcohol, brassidyl alcohol, or oleyl alcohol (3-10 moles of EO) and/or tallow alcohol ethoxylate (3-10 moles of EO).

5. Fibers according to claim 1, characterized in that said surface treatment agent consists of 50 to 60% by weight, of (a),
25 to 40% by weight, of (b),
5 to 10% by weight, of (c),
0.3 to 1% by weight, of (d), and
optionally additives (e).

6. Fibers according to claim 1, characterized in that repeating units of the aramid have the general formula $$(-NH-A_1-NH-CO-A_2-CO-)_n$$

wherein $A_1$ and $A_2$ are the same or different and represent substituted or unsubstituted aromatic and/or polyaromatic and/or heteroaromatic rings.

7. Fibers according to claim 6 characterized in that $A_1$ and $A_2$ are, independently from each other, selected from 1,4-phenylene, 1,3-phenylene, 1,2-phenylene, 4,4'-biphenylene, 2,6-naphthylene, 1,5-naphthylene, 1,4-naphthylene, phenoxyphenyl-4,4'-diyl, phenoxyphenyl-3,4'-diyl, 2,5-pyridylene and 2,6-quinolylene and which may or may not be substituted by one or more substituents comprising halogen, $C_1$-$C_4$-alkyl, phenyl, carboalkoxyl, $C_1$-$C_4$-alkoxyl, acyloxy, nitro, dialkylamino, thioalkyl, carboxyl and sulfonyl and in which the amide-group may also be replaced by a carbonylhydrazide-, azo- or azoxy-group.

8. Fibers according to claim 6, characterized in that the aromatic polyamide is a copolyamide in which preferably at least 80% by mole of the total $A_1$ and $A_2$ are 1,4-phenylene and phenoxyphenyl-3,4'-diyl which may or may not be substituted, and the content of phenoxyphenyl-3,4'-diylene is 10% to 40% by mole.

9. Fibers according to claim 6, characterized in that the polyamide fibers consist of poly-(m-phenyleneisophthalamide).

10. Fibers according to claim 6, characterized in that the polyamide fibers consist of poly-p-(phenyleneterephthalamide).

11. Fibers according to claim 6, characterized in that said polyamide fibers contain optionally units which are derived from 3- or 4-aminobenzoic acid.

12. A process for making aramid fibers having a coating of a surface treatment agent, comprising the steps of applying the surface treatment agent to said fiber in an aqueous system of concentration 1 to 100%, by weight, drying the fibers at a temperature between 150° and 190° C., optionally, repeating the application of the surface treatment agent, characterized further in that the surface treatment agent consists of (a) 30 to 70% by weight of an esteroil lubricant, consisting of an ester, composed of (I) an alcohol component which is a branched, primary or secondary, saturated monohydric alcohol of the general formula $$CH_3-(CH_2)_h-\underset{}{\overset{R^1}{\overset{|}{(CH)}}}_k-(CH_2)_j-\overset{R^2}{\overset{|}{CH}}-(CH_2)_m-OH$$

wherein $R^1$ represents $C_1$-$C_{16}$-alkyl,
$R^2$ represents H, $C_1$-$C_{16}$-alkyl, if k=1 and
$R^2$ represents $C_1$-$C_{16}$-alkyl, if k=0,
h=0 to 5
j=0 to 4
k=0 or 1
m=0 to 16
and wherein the total number of carbon atoms is below 25,
and (II) a carboxylic acid component which is an unsaturated fatty acid of the general formula $$R^3-(COOH)_s;\ s=1-6$$

wherein $R^3$ represents $C_4$-$C_{19}$-alkenyl, $C_4$-$C_{19}$-alkadienyl, $C_4$-$C_{19}$-alkatrienyl, phenyl, naphthyl, 2-phenylethenyl, or which is an unsaturated dicarboxylic acid of the general formula $$HOOC-(CH=CH)_n-COOH$$

wherein n=1 or 2, and said ester has a solidification point of below +5° C., a kinematic viscosity of 100 to 350 $mm^2/s$ (at 20° C.) and an iodine value between 30 and 140, (b) 20 to 50% by weight of an emulsifying system which consists of unsaturated ethoxylated fatty acids and/or unsaturated ethoxylated fatty alcohols and/or ethoxylated alkylamines of the general formula $$R^4-X-(EO)_p(PO)_q-OH$$

wherein $R^4$ represents $C_5$-$C_{20}$-alkenyl, phenyl, naphthyl, or $C_8$- or $C_9$-alkylphenyl,
X represents —COO—, —NH— or —O—,
EO represents an ethylene oxide unit,
PO represents a propylene oxide unit,
p=2 to 15 and
q=0 to 10, (c) 5 to 15% by weight of an antistatic agent, consisting of alkali salts of $C_4$-$C_{12}$-alkyl sulfonates, $C_4$-$C_{12}$-alkyl phosphates or $C_4$-$C_{20}$-alkyl carboxylic acids, (d) 0.2 to 2% by weight of a corrosion-inhibitor, and (e) optionally additives

13. Process according to claim 12, characterized in that the concentration of the surface treatment agent in water is 30% by weight.

14. Process according to claim 12, characterized in that the concentration of the surface treatment is 100%, by weight, that is, that the surface treatment is neat.

15. Process according to claim 12, characterized in that the surface treatment agent is applied to never-dried aramid fibers.

16. Process according to claim 12, characterized in that the surface treatment agent is applied to previously-dried aramid fibers.

* * * * *